US007917978B2

(12) United States Patent
Ruschke et al.

(10) Patent No.: US 7,917,978 B2
(45) Date of Patent: Apr. 5, 2011

(54) VARIABLE HEIGHT SIDERAIL FOR A BED

(75) Inventors: Jeffrey A. Ruschke, Lawrenceburg, IN (US); K. Clarence King, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 788 days.

(21) Appl. No.: 10/598,758

(22) PCT Filed: Mar. 2, 2005

(86) PCT No.: PCT/US2005/006849

§ 371 (c)(1),
(2), (4) Date: Dec. 5, 2007

(87) PCT Pub. No.: WO2005/092153

PCT Pub. Date: Oct. 6, 2005

(65) Prior Publication Data

US 2008/0127415 A1 Jun. 5, 2008

Related U.S. Application Data

(60) Provisional application No. 60/552,618, filed on Mar. 12, 2004.

(51) Int. Cl.
*A47C 21/08* (2006.01)

(52) U.S. Cl. ..... 5/428; 5/430

(58) Field of Classification Search ..... 5/600, 424–430, 5/658

See application file for complete search history.

(56) References Cited

U.S. PATENT DOCUMENTS

| | | | | |
|---|---|---|---|---|
| 421,656 | A | 2/1890 | Blanken | |
| 993,119 | A | 5/1911 | Stannard | |
| 1,398,203 | A | 11/1921 | Schmidt | |
| 1,601,983 | A | 10/1926 | Savage | |
| 1,938,635 | A | 12/1933 | North | |
| 2,136,088 | A | 11/1938 | Stevens | |
| 2,164,484 | A | 7/1939 | Wolfe | |
| 2,281,209 | A | 4/1942 | Smith | |
| 2,306,934 | A | 12/1942 | Cade | |
| 2,452,366 | A | 10/1948 | Freund | |
| 2,556,591 | A | 6/1951 | Loxley | |
| 2,564,083 | A | 8/1951 | Stechert | |
| 2,587,291 | A * | 2/1952 | Des Rochers | 5/430 |
| 2,605,151 | A | 7/1952 | Shampaine | |
| 2,625,694 | A | 1/1953 | Moss | |

(Continued)

FOREIGN PATENT DOCUMENTS

DE 199 00 602 C 1 7/2000

(Continued)

OTHER PUBLICATIONS

Paramount Bed Product Brochure, date unknown.

(Continued)

*Primary Examiner* — Michael Trettel
*Assistant Examiner* — William Kelleher
(74) *Attorney, Agent, or Firm* — Barnes & Thornburg LLP

(57) ABSTRACT

A patient support (10) includes a frame (12), a mattress supported by the frame, and a set of siderails (18-20) configured to block the egress of a patient from the patient support (10). The siderails (18-20) are configured to reduce gaps defined between the siderails (18-20) and other components of the patient support (10).

22 Claims, 14 Drawing Sheets

U.S. PATENT DOCUMENTS

| | | | | | |
|---|---|---|---|---|---|
| 2,644,173 | A | | 7/1953 | James | |
| 2,710,976 | A | | 6/1955 | Martensen | |
| 2,722,017 | A | | 11/1955 | Burst et al. | |
| 2,766,463 | A | | 10/1956 | Bendersky | |
| 2,817,854 | A | | 12/1957 | Pratt | |
| 2,817,855 | A | * | 12/1957 | Pratt | 5/430 |
| 2,869,614 | A | | 1/1959 | Wamsley | |
| 2,951,252 | A | | 9/1960 | Roche | |
| 3,010,121 | A | | 11/1961 | Breach | |
| 3,018,492 | A | | 1/1962 | Rosen | |
| 3,021,534 | A | | 2/1962 | Hausted | |
| 3,053,568 | A | | 9/1962 | Miller | |
| 3,055,020 | A | | 9/1962 | Mann | |
| 3,063,066 | A | * | 11/1962 | Peck et al. | 5/429 |
| 3,069,700 | A | | 12/1962 | Berlin | |
| 3,099,440 | A | | 7/1963 | Burzlaff | |
| 3,112,500 | A | | 12/1963 | MacDonald | |
| 3,125,769 | A | * | 3/1964 | Black | 5/430 |
| 3,138,805 | A | | 6/1964 | Piazza | |
| 3,148,387 | A | | 9/1964 | Sarnie et al. | |
| 3,210,779 | A | | 10/1965 | Herbold | |
| 3,220,021 | A | | 11/1965 | Nelson | |
| 3,220,022 | A | | 11/1965 | Nelson | |
| 3,220,024 | A | | 11/1965 | Nelson | |
| 3,233,255 | A | | 2/1966 | Propst | |
| 3,239,853 | A | | 3/1966 | MacDonald | |
| 3,249,387 | A | | 5/1966 | Pivacek | |
| 3,256,533 | A | | 6/1966 | Michelsen | |
| 3,309,717 | A | | 3/1967 | Black | |
| 3,321,779 | A | | 5/1967 | Kaufman et al. | |
| 3,344,445 | A | | 10/1967 | Crawford | |
| 3,351,961 | A | | 11/1967 | Daniels et al. | |
| 3,351,962 | A | | 11/1967 | Dodrill et al. | |
| 3,406,772 | A | | 10/1968 | Ahrent et al. | |
| 3,430,272 | A | | 3/1969 | Thorn, Jr. | |
| 3,456,269 | A | | 7/1969 | Goodman | |
| 3,486,176 | A | | 12/1969 | Murcott | |
| 3,585,659 | A | * | 6/1971 | Burst | 5/430 |
| 3,593,350 | A | | 7/1971 | Knight et al. | |
| 3,606,656 | A | | 9/1971 | Kumagai et al. | |
| 3,619,824 | A | | 11/1971 | Doyle | |
| 3,640,556 | A | | 2/1972 | Bennett | |
| 3,742,530 | A | | 7/1973 | Clark | |
| 3,845,511 | A | | 11/1974 | Benoit et al. | |
| 3,851,345 | A | | 12/1974 | Benoit et al. | |
| 3,865,434 | A | * | 2/1975 | Sully | 297/411.33 |
| 3,877,090 | A | | 4/1975 | Schutz | |
| 3,893,197 | A | | 7/1975 | Ricke | |
| 3,897,973 | A | | 8/1975 | Long et al. | |
| 3,905,591 | A | | 9/1975 | Schorr et al. | |
| 3,916,461 | A | | 11/1975 | Kerstholt | |
| 3,971,083 | A | | 7/1976 | Peterson | |
| 4,127,906 | A | | 12/1978 | Zur | |
| 4,139,917 | A | | 2/1979 | Fenwick | |
| 4,168,099 | A | | 9/1979 | Jacobs et al. | |
| 4,183,015 | A | | 1/1980 | Drew et al. | |
| 4,186,456 | A | | 2/1980 | Huempfner | |
| 4,214,326 | A | | 7/1980 | Spann | |
| 4,215,446 | A | | 8/1980 | Mahoney | |
| 4,232,415 | A | | 11/1980 | Webber | |
| 4,240,169 | A | | 12/1980 | Roos | |
| 4,258,445 | A | | 3/1981 | Zur | |
| 4,312,500 | A | | 1/1982 | Janssen | |
| 4,336,621 | A | | 6/1982 | Schwartz et al. | |
| 4,370,765 | A | | 2/1983 | Webber | |
| 4,409,695 | A | | 10/1983 | Johnston et al. | |
| 4,437,704 | A | | 3/1984 | Hovsepians | |
| 4,439,880 | A | | 4/1984 | Koncelik et al. | |
| 4,453,732 | A | | 6/1984 | Assanah et al. | |
| D276,112 | S | | 10/1984 | Ferrell et al. | |
| 4,523,745 | A | | 6/1985 | Killman et al. | |
| 4,557,471 | A | | 12/1985 | Pazzini | |
| 4,607,402 | A | | 8/1986 | Pollard | |
| 4,612,679 | A | | 9/1986 | Mitchell | |
| 4,653,129 | A | | 3/1987 | Kuck et al. | |
| 4,654,903 | A | | 4/1987 | Chubb et al. | |
| 4,670,923 | A | | 6/1987 | Gabriel et al. | |
| 4,672,698 | A | | 6/1987 | Sands | |
| 4,675,926 | A | | 6/1987 | Lindblom et al. | |
| 4,676,687 | A | | 6/1987 | Koffler | |
| 4,685,159 | A | | 8/1987 | Oetiker | |
| 4,704,750 | A | | 11/1987 | Wheelock | |
| 4,710,049 | A | | 12/1987 | Chang | |
| 4,710,992 | A | | 12/1987 | Falwell et al. | |
| 4,745,647 | A | | 5/1988 | Goodwin | |
| 4,747,171 | A | * | 5/1988 | Einsele et al. | 5/425 |
| 4,751,754 | A | | 6/1988 | Bailey et al. | |
| 4,767,419 | A | | 8/1988 | Fattore | |
| 4,768,249 | A | | 9/1988 | Goodwin | |
| 4,783,864 | A | | 11/1988 | Turner | |
| 4,800,600 | A | | 1/1989 | Baum | |
| 4,827,545 | A | | 5/1989 | Arp | |
| 4,839,933 | A | | 6/1989 | Plewright et al. | |
| 4,847,929 | A | | 7/1989 | Pupovic | |
| 4,858,260 | A | | 8/1989 | Failor et al. | |
| 4,862,529 | A | | 9/1989 | Peck | |
| 4,862,530 | A | | 9/1989 | Chen | |
| 4,872,228 | A | | 10/1989 | Bishop | |
| 4,873,734 | A | | 10/1989 | Pollard | |
| 4,894,876 | A | | 1/1990 | Fenwick | |
| 4,944,055 | A | | 7/1990 | Shainfeld | |
| 4,974,905 | A | | 12/1990 | Davis | |
| 4,985,942 | A | | 1/1991 | Shaw | |
| 4,985,946 | A | | 1/1991 | Foster et al. | |
| 4,993,089 | A | * | 2/1991 | Solomon et al. | 5/430 |
| 5,010,611 | A | | 4/1991 | Mallett | |
| 5,035,014 | A | | 7/1991 | Blanchard | |
| 5,040,253 | A | | 8/1991 | Cheng | |
| 5,044,025 | A | | 9/1991 | Hunsinger et al. | |
| 5,060,327 | A | | 10/1991 | Celestina et al. | |
| 5,072,463 | A | | 12/1991 | Willis | |
| 5,077,843 | A | | 1/1992 | Foster et al. | |
| 5,083,332 | A | | 1/1992 | Foster et al. | |
| 5,083,334 | A | | 1/1992 | Huck et al. | |
| 5,084,925 | A | | 2/1992 | Cook | |
| 5,097,550 | A | | 3/1992 | Marra, Jr. | |
| 5,129,117 | A | | 7/1992 | Celestina et al. | |
| 5,175,897 | A | | 1/1993 | Marra | |
| 5,179,744 | A | | 1/1993 | Foster et al. | |
| 5,187,824 | A | | 2/1993 | Stryker | |
| 5,191,663 | A | | 3/1993 | Holder et al. | |
| 5,193,633 | A | | 3/1993 | Ezenwa | |
| 5,197,156 | A | | 3/1993 | Stryker et al. | |
| 5,205,004 | A | | 4/1993 | Hayes et al. | |
| D336,577 | S | | 6/1993 | Celestina et al. | |
| 5,216,768 | A | | 6/1993 | Bodine et al. | |
| 5,230,113 | A | | 7/1993 | Foster et al. | |
| 5,279,010 | A | | 1/1994 | Ferrand et al. | |
| 5,323,631 | A | | 6/1994 | Weykamp et al. | |
| 5,345,629 | A | | 9/1994 | Ferrand | |
| 5,365,623 | A | | 11/1994 | Springer | |
| 5,371,909 | A | | 12/1994 | McCarty | |
| 5,381,571 | A | | 1/1995 | Gabhart | |
| 5,384,927 | A | | 1/1995 | Mardero et al. | |
| 5,410,765 | A | | 5/1995 | Youngblood | |
| 5,418,988 | A | | 5/1995 | Iura | |
| 5,421,046 | A | | 6/1995 | Vande Streek | |
| 5,450,641 | A | | 9/1995 | Montgomery | |
| 5,454,126 | A | | 10/1995 | Foster et al. | |
| 5,455,973 | A | | 10/1995 | Brumfield et al. | |
| 5,469,591 | A | | 11/1995 | Nomura | |
| 5,479,666 | A | | 1/1996 | Foster et al. | |
| 5,481,772 | A | | 1/1996 | Glynn et al. | |
| 5,485,699 | A | | 1/1996 | Gabhart | |
| 5,524,306 | A | | 6/1996 | George | |
| 5,537,701 | A | | 7/1996 | Elliott | |
| 5,542,135 | A | | 8/1996 | Ozrovitz et al. | |
| 5,557,817 | A | | 9/1996 | Haddock | |
| 5,575,025 | A | | 11/1996 | Peters | |
| 5,577,277 | A | | 11/1996 | Sundberg et al. | |
| 5,577,279 | A | | 11/1996 | Foster et al. | |
| 5,590,826 | A | | 1/1997 | Endo | |
| 5,642,545 | A | | 7/1997 | Howard | |
| 5,671,490 | A | | 9/1997 | Wu | |
| 5,678,267 | A | | 10/1997 | Kinder | |
| 5,689,839 | A | | 11/1997 | Langaniere et al. | |
| 5,700,053 | A | | 12/1997 | Downing | |

| | | | |
|---|---|---|---|
| 5,715,548 | A | 2/1998 | Weismiller et al. |
| 5,732,423 | A | 3/1998 | Weismiller et al. |
| 5,741,140 | A | 4/1998 | Bristol |
| 5,745,937 | A | 5/1998 | Weismiller et al. |
| 5,749,112 | A | 5/1998 | Metzler |
| 5,761,756 | A | 6/1998 | Nowak et al. |
| 5,771,506 | A | 6/1998 | Joiner |
| 5,781,945 | A | 7/1998 | Scherer et al. |
| 5,802,636 | A | 9/1998 | Corbin et al. |
| 5,832,549 | A | 11/1998 | Le Pallec et al. |
| 5,862,759 | A | 1/1999 | Mauli et al. |
| 5,864,900 | A | 2/1999 | Landau |
| 5,875,792 | A | 3/1999 | Campbell, Jr. et al. |
| 5,878,452 | A | 3/1999 | Brooke et al. |
| 5,890,244 | A | 4/1999 | Cartwright et al. |
| 5,926,873 | A | 7/1999 | Fountain |
| 5,934,754 | A | 8/1999 | Raffa |
| 5,987,666 | A | 11/1999 | Zigmont |
| 6,038,721 | A | 3/2000 | Gordon |
| 6,058,531 | A | 5/2000 | Carroll |
| 6,089,593 | A | 7/2000 | Hanson et al. |
| 6,279,795 | B1 | 8/2001 | Pierzina |
| 6,347,422 | B2 | 2/2002 | Heavrin |
| 6,374,440 | B1 | 4/2002 | Thim, Jr. |
| 6,397,416 | B2 | 6/2002 | Brooke et al. |
| 6,401,277 | B1 | 6/2002 | Savage et al. |
| 6,401,281 | B1 | 6/2002 | Younge |
| 6,427,264 | B1 | 8/2002 | Metz et al. |
| 6,430,766 | B1 | 8/2002 | Henley et al. |
| 6,615,426 | B1 | 9/2003 | Risk, Jr. |
| 6,622,323 | B2 | 9/2003 | Zerhusen et al. |
| 6,658,681 | B2 | 12/2003 | Britto et al. |
| 6,829,793 | B2 | 12/2004 | Brooke et al. |
| 7,007,323 | B2 | 3/2006 | Zerhusen et al. |
| 7,028,352 | B2 * | 4/2006 | Kramer et al. ..... 5/425 |
| 7,559,101 | B2 * | 7/2009 | Vrzalik et al. ..... 5/430 |
| 2003/0093860 | A1 * | 5/2003 | Kramer et al. ..... 5/600 |
| 2004/0000010 | A1 | 1/2004 | Zerhusen et al. |
| 2004/0040092 | A1 | 3/2004 | Hensley et al. |

FOREIGN PATENT DOCUMENTS

| | | |
|---|---|---|
| EP | 0 037 063 | 10/1981 |
| EP | 1053705 | 11/2000 |
| FR | 1450817 | 8/1966 |
| GB | 1466080 | 3/1977 |
| GB | 2136280 | 9/1984 |
| GB | 2 313 303 | 11/1997 |
| JP | 09004167 | 1/1997 |
| JP | 10266510 | 10/1998 |
| WO | WO 98/17153 | 4/1998 |
| WO | WO 9819497 | 5/1998 |
| WO | WO 99/15126 | 4/1999 |
| WO | WO 00/76372 | 12/2000 |

OTHER PUBLICATIONS

Hill-Rom Med Surg. Bed Accessories, 1997.

* cited by examiner

VARIABLE HEIGHT SIDERAIL FOR A BED

CROSS-REFERENCE TO RELATED APPLICATIONS

This application is the U.S. national phase under 35 U.S.C. §371 of PCT International Application No. PCT/US2005/006849, which has an international filing date of Mar. 2, 2005, designating the United States of America, and claims the benefit of U.S. Provisional Patent Application No. 60/552,618, which was filed Mar. 12, 2004. The disclosures of each of these prior applications are hereby incorporated by reference herein.

BACKGROUND OF THE INVENTION

The present invention relates to patient supports, such as hospital beds. More particularly, the present invention relates a variable height siderail which is configured to close gaps that may exist between components on a patient support.

BRIEF DESCRIPTION OF THE DRAWINGS

The detailed description particularly refers to the accompanying figures in which.

DETAILED DESCRIPTION OF THE DRAWINGS

Figure 1:
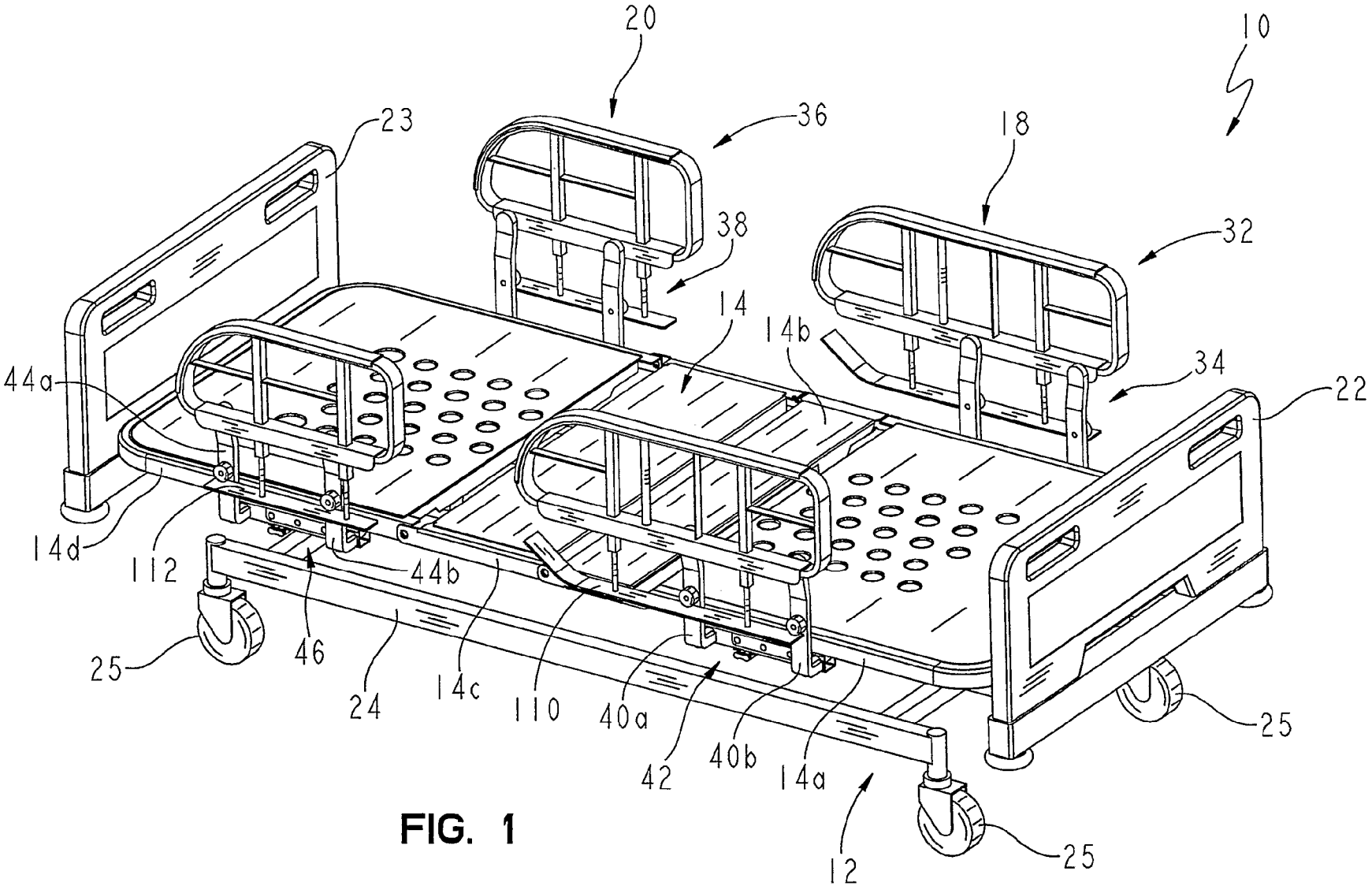
FIG. 1 is a perspective view of an illustrative embodiment patient support including a pair of head end siderails, and a pair of foot end siderails, showing the head end siderails and the foot end siderails in raised positions.
Figure 2:
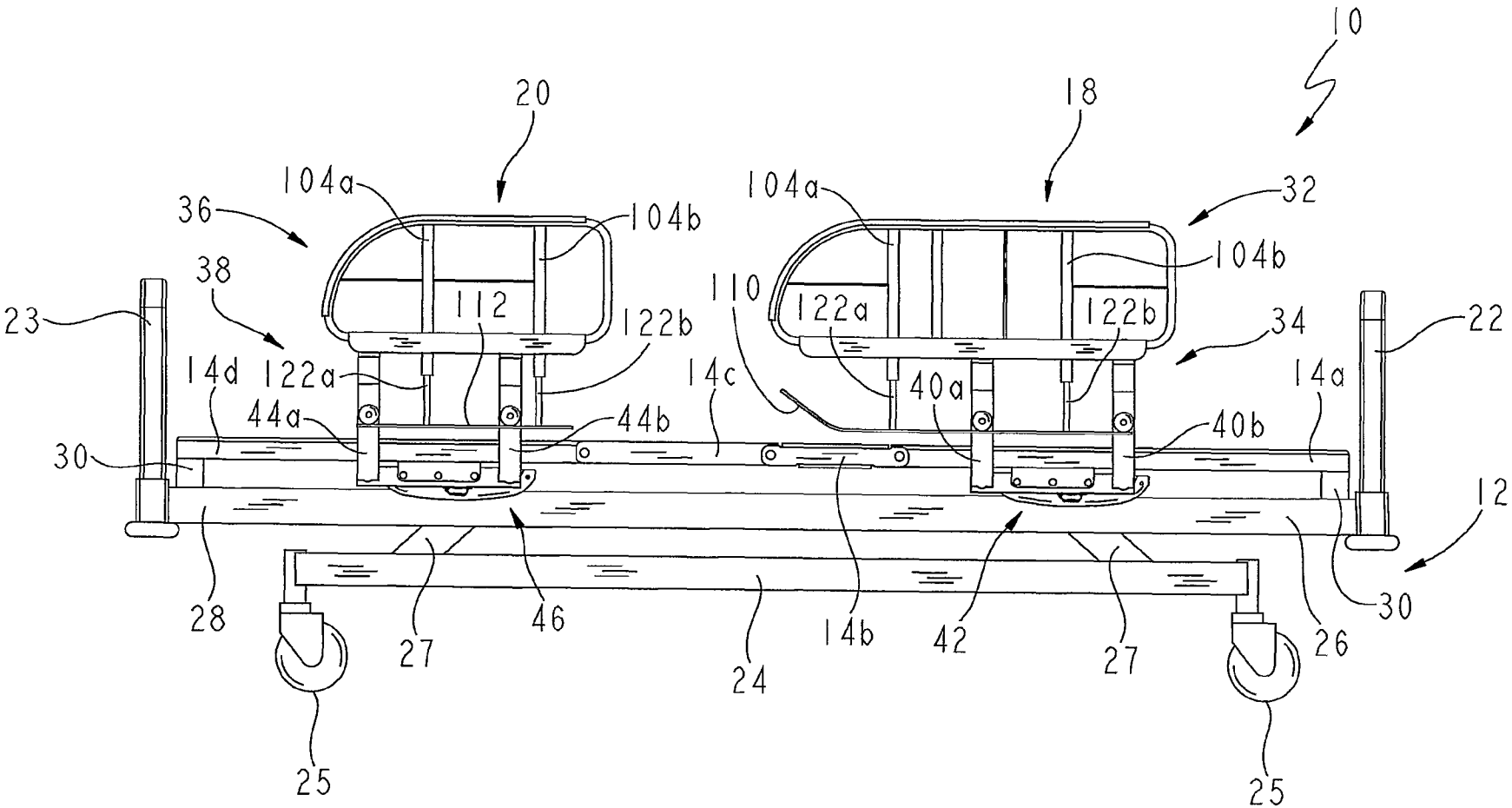
FIG. 2 is a side elevation view of the patient support of FIG. 1, showing the head end siderail and foot end siderails in lowered positions.
Figure 3:
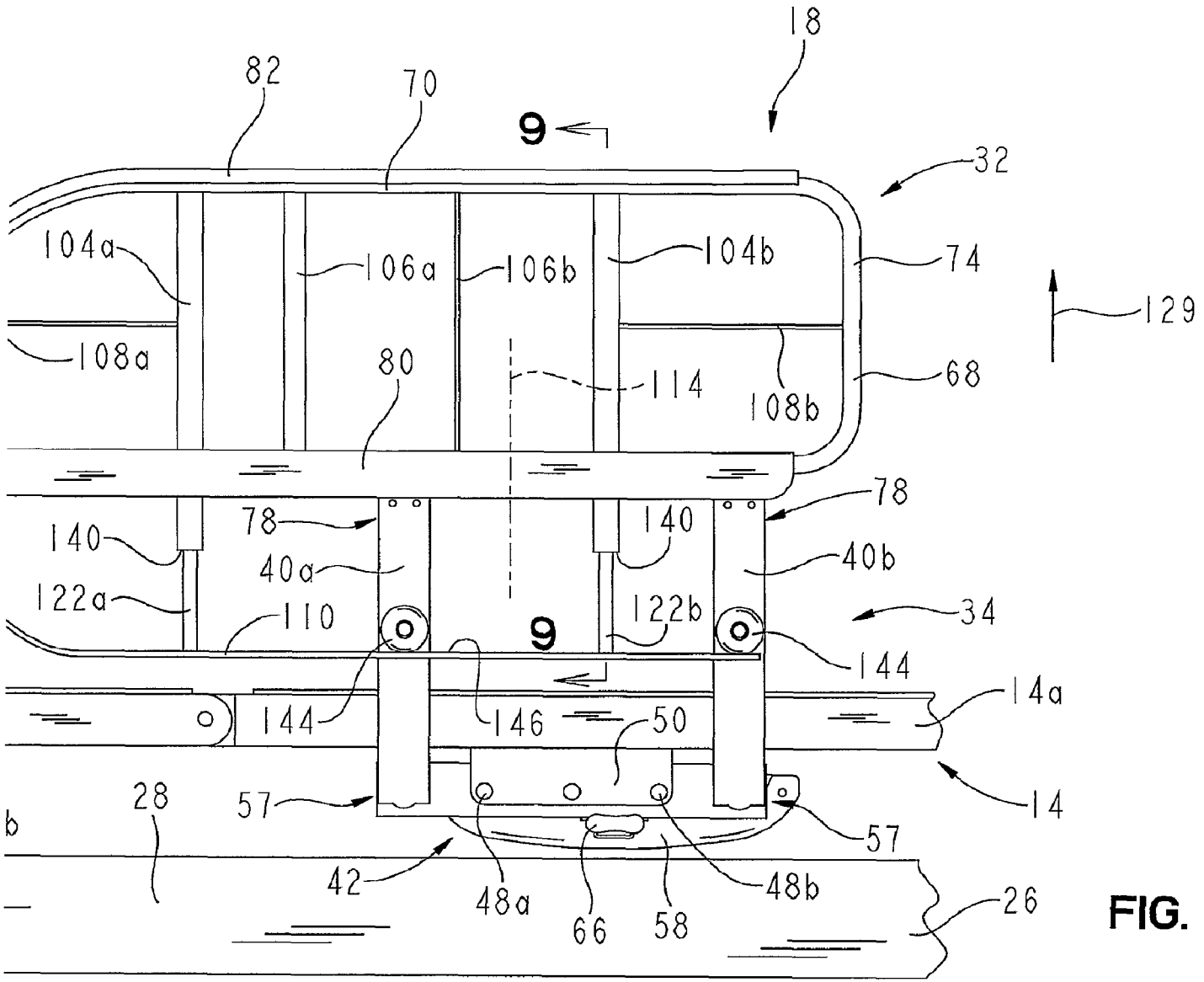
FIG. 3 is a front elevational view of the head end siderail in a raised position, wherein the head rail member is in a raised position and the rail extension is in an extended position.
Figure 4:
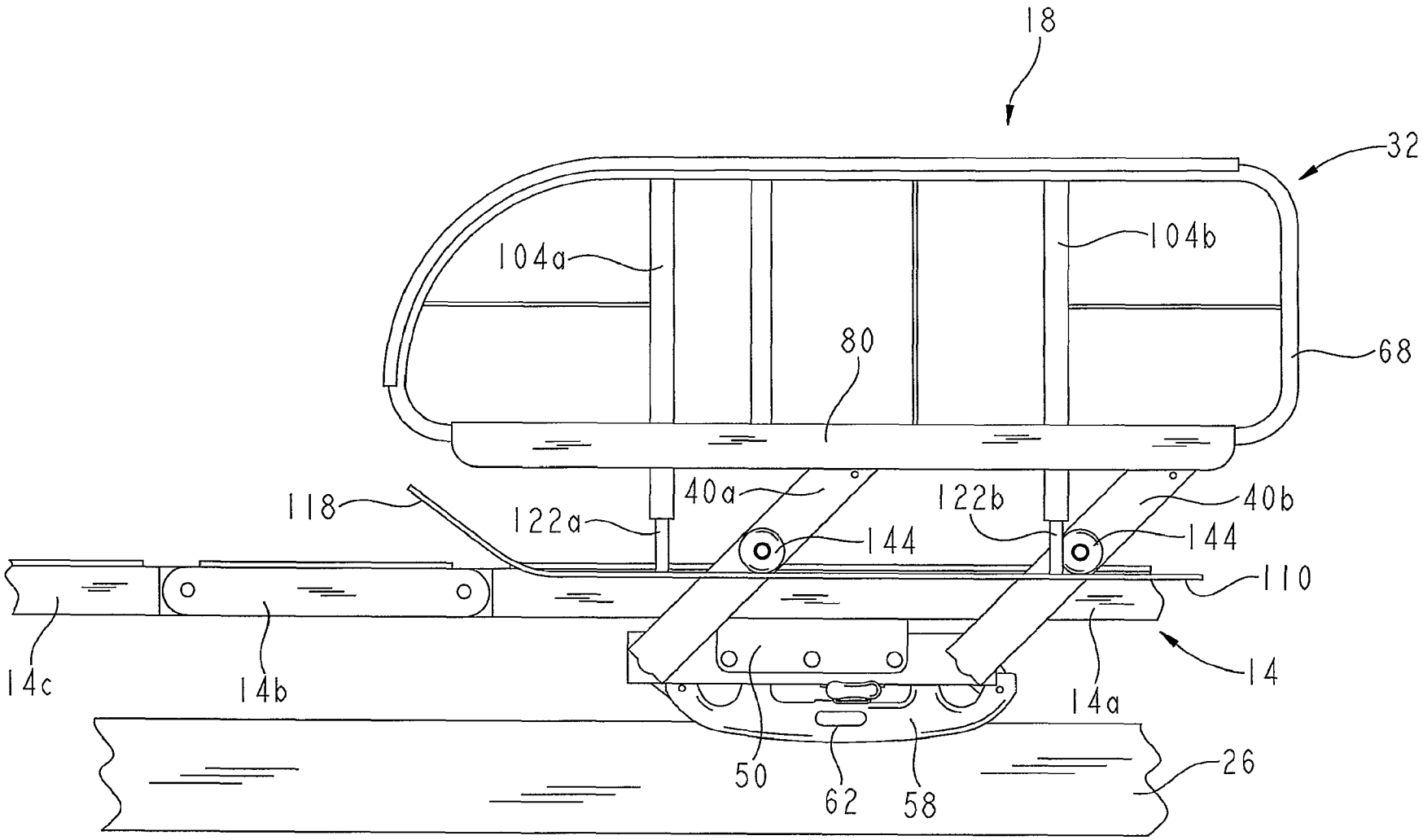
FIG. 4 is a front elevational view similar to FIG. 3, illustrating the head end siderail in a first intermediate position between the raised position and the lowered position.
Figure 5:
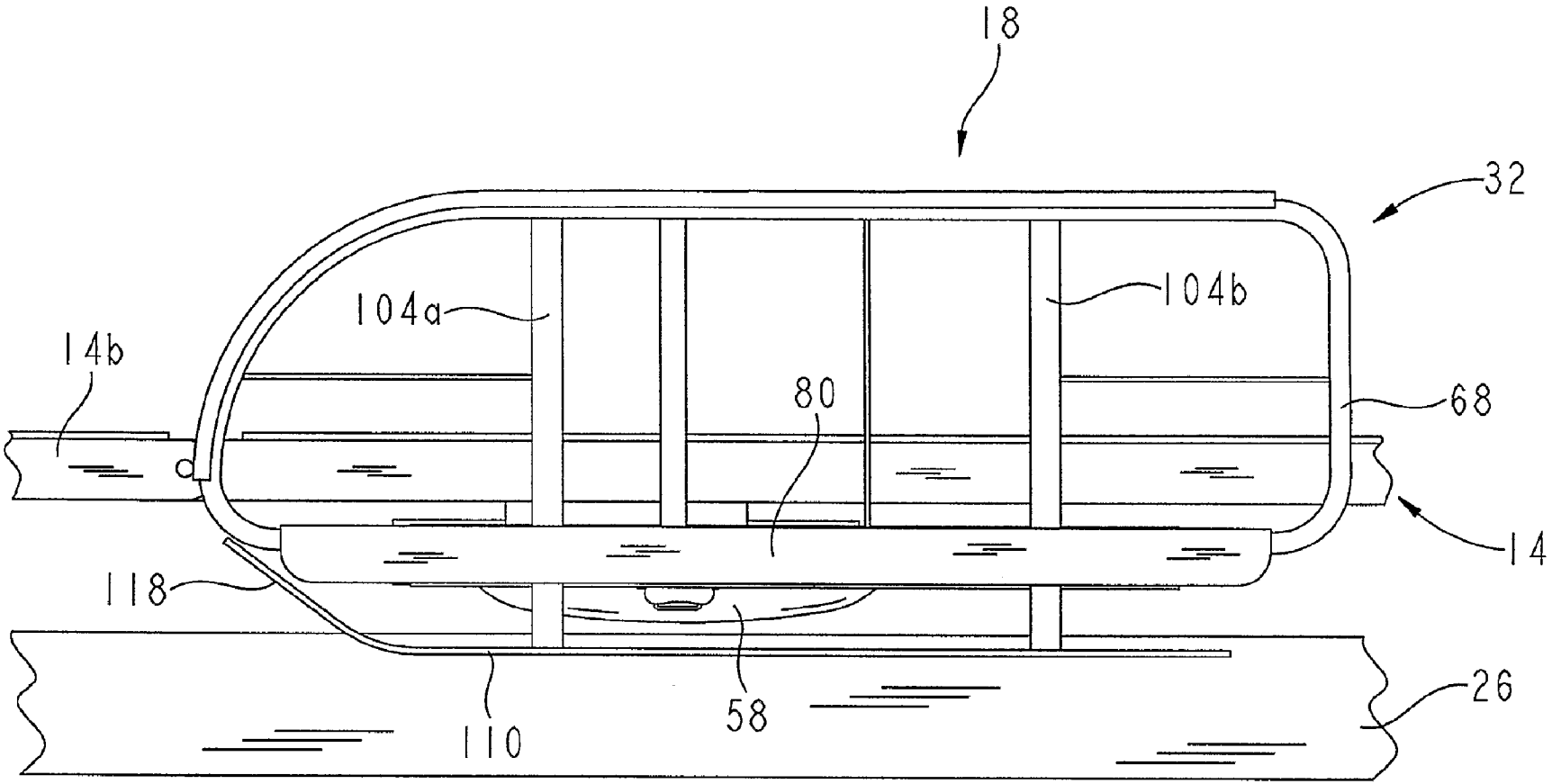
FIG. 5 is a front elevational view similar to FIG. 3, illustrating the head end siderail in a second intermediate position below the first intermediate position and between the raised position and the lowered position.

A patient support 10 according to an illustrative embodiment of the present invention is shown in FIGS. 1 and 2.

Patient support 10 includes a frame 12, a deck 14, a pair of head end siderails 18, a pair of foot end siderails 20, a headboard 22, and a footboard 23. A conventional mattress (not shown) is supported by the deck 14 which includes a head section 14*a*, a seat section 14*b*, a thigh section 14*c*, and a foot section 14*d*, all of which are configured to move relative to one another in a manner known in the art.

Frame 12 illustratively includes a base frame 24 supported by a plurality of casters 25 and coupled to an intermediate frame 26 (FIG. 2). As known in the art, the intermediate frame 26 may be vertically moved relative to the base frame 24 by lift arms 27. The intermediate frame 26 includes a pair of longitudinally extending frame members 28 and a pair of laterally extending cross members 30. Head end siderails 18 each include a rail member 32 coupled to a linkage 34. Similarly, foot end siderails 20 each include a rail member 36 coupled to a linkage 38. Linkage 34 includes first and second longitudinally spaced support arms 40*a* and 40*b* which pivotally couple rail member 32 to a linkage base 42, while linkage 38 includes first and second longitudinally spaced support arms 44*a* and 44*b* which pivotally couple rail member 36 to a linkage base 46. Both head end siderails 18 and foot end siderails 20 may be raised and lowered by rotating or "clocking" rail members 32 and 36 about the respective arms 40 and 44. More particularly, head end siderails 18 are configured to be moved in a direction toward the headboard 22, while foot end siderails 20 are configured to be moved in a direction toward the footboard 23.

While the following description details linkage base 42 for supporting linkage 34 of head end siderail 18, the linkage base 46 has a substantially identical structure for supporting linkage 38 of foot end siderail 20. With reference to FIGS. 3-8, linkage bases 42 and 46 each include a slide bracket 47 supported for lateral sliding movement along a pair of rods 48*a* and 48*b*. Rods 48*a* and 48*b* each have a first end supported by a downwardly extending mounting bracket 50 coupled to a lower surface 52 of the deck 14 and a second end supported by a flange 54 extending downwardly from the lower surface 52 and positioned laterally inwardly from the mounting bracket 50. Sliding of the slide bracket 47 along rods 48*a* and 48*b* permits lateral movement of linkage base 42, 46 and the respective siderail 18, 20 relative to deck 14. Head end siderails 18 are coupled to head section 14*a* by rods 48 and are configured to move with head section 14*a*, while foot end siderails 20 are coupled to foot section 14*d* by rods 48 and are configured to move with foot section 14*d*.

Rotatable rods 56*a* and 56*b* are coupled to first ends 57 of arms 44*a* and 44*b*, respectively, and pass through openings in the slide bracket 47. Rods 56*a* and 56*b* are coupled to a locking member 58 by tear drop shaped connecting links 60*a* and 60*b*, wherein rotation of the rods 56*a* and 56*b* causes movement of the locking member 58. Locking member 58 includes an opening 62 configured to slidably receive a latch member 64. Latch member 64 is spring biased laterally inwardly and is coupled to a handle 66. More particularly, latch member 64 is biased into opening 62 for preventing movement of locking member 58 relative to slide bracket 47 and, in turn, deck 14. As such, respective arms 40, 44 are prevented from rotating or clocking, and respective siderail 18, 20 is prevented from moving relative to deck 14. Pulling of handle 66 laterally outwardly results in the withdraw of latch member 62 from within opening 62, thereby freeing locking member 58 for movement relative to slide bracket 47. As such, respective arms 40, 44 are permitted to rotate or clock, and respective siderail 18, 20 is permitted to move relative to deck 14.

Referring to FIGS. 2-6 and 9-12, head end rail member 32 includes a steel frame member 68 having a horizontal upper rail portion 70, a first vertical end rail portion 72 coupled to a first end of the upper rail portion 70, and a second end rail portion 74 coupled to a second end of the upper rail portion 70. First ends 57 of support arms 40 are coupled to the deck 14 through slide bracket 47 as detailed above. Opposing second ends 78 of support arms 40 are coupled to a downwardly extending mounting bracket 80. Bracket 80 extends between first and second end rail portions 52 and 54 substantially parallel to upper rail portion 70. A plastic cane or cover 82 may be coupled to frame member 68. Similarly, a two-piece plastic housing 84 (FIG. 11) may be coupled to head end rail member 32 and may include operational controls, switches or buttons of the type known in the art.

Figure 13:
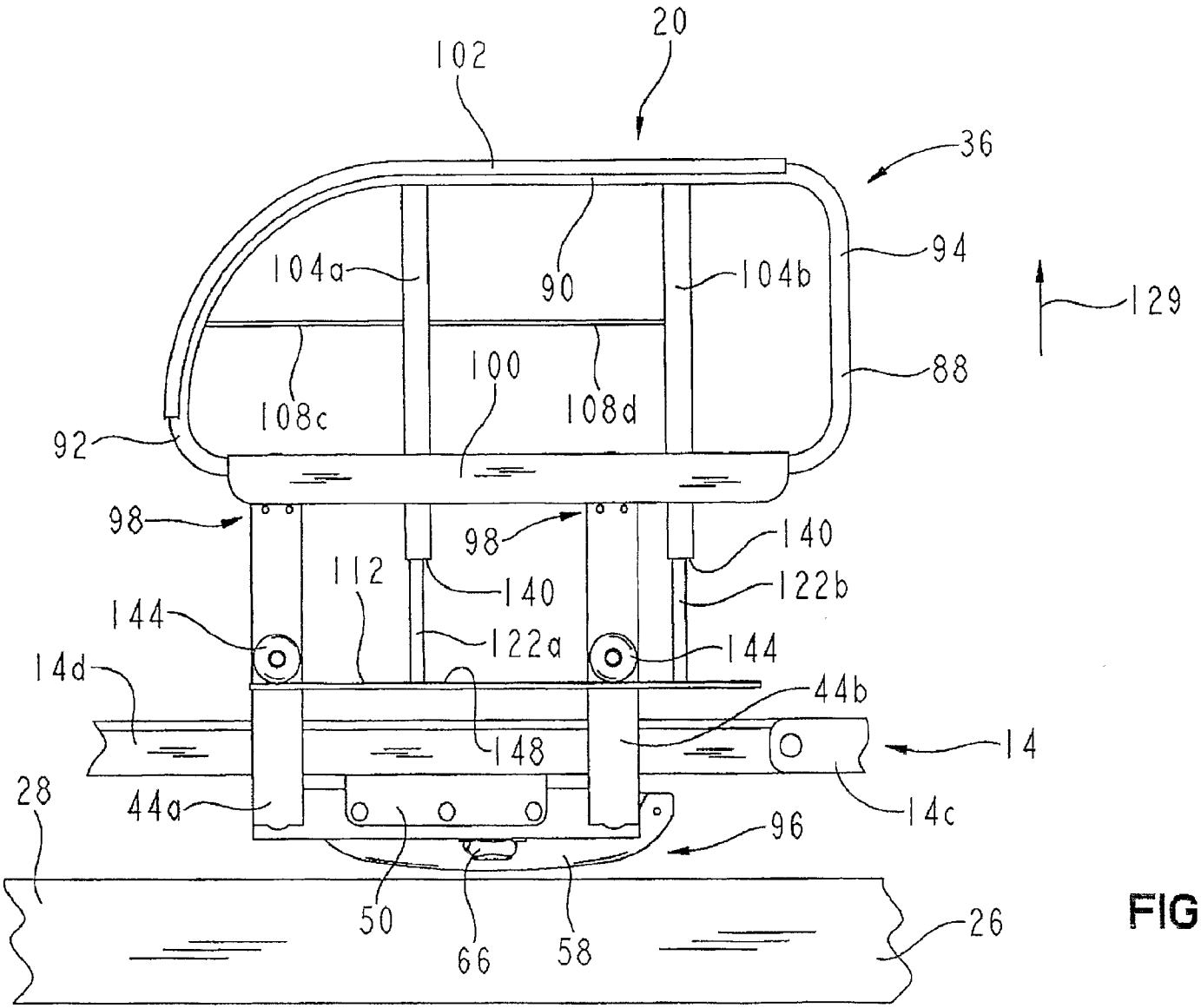
FIG. 13 is a front elevational view of the foot end siderail.
Figure 14:
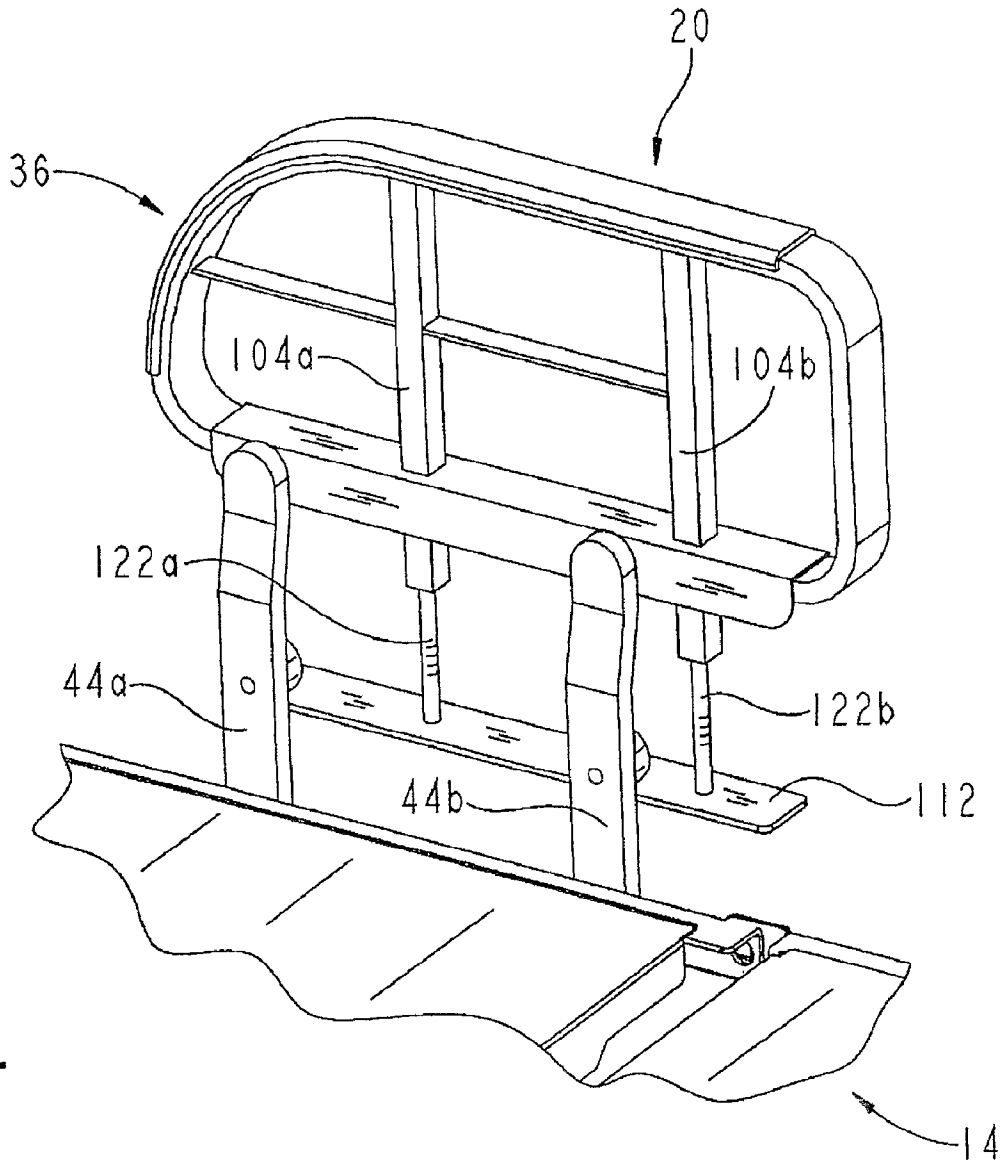
FIG. 14 is a rear perspective view of the foot end siderail.

Referring to FIGS. 2, 13, and 14, foot end rail member 36 includes a steel frame member 88 having a horizontal upper rail portion 90, a first vertical end rail portion 92 coupled to a first end of the upper rail portion 90, and a second vertical end rail portion 94 coupled to a second end of the upper rail portion 90. First ends 96 of support arms 44 are coupled to deck 14 through slide bracket 47 as detailed above. Opposing second ends 98 of support arms 44 are coupled to a downwardly extending bracket 100. Bracket 100 extends between first and second end rail portions 92 and 94 substantially parallel to upper rail portion 90. A plastic cane or cover 102 is illustratively coupled to the frame member 68. Preferably, frame members 68 and 88 of siderails 18 and 20 are substantially parallelogram shaped including slightly rounded corners.

The head end siderail 18 includes first and second tubular guides 104*a* and 104*b* extending vertically between mounting bracket 80 and upper rail portion 70. First and second vertical blocking members 106*a* and 106*b* extend between mounting bracket 80 and upper rail portion 70, intermediate first and second tubular guides 104*a* and 104*b*, and restrict the clearance therebetween. Horizontal blocking member 108*a* extends between end rail portion 72 and first guide 104*a* to reduce space therebetween. Horizontal blocking member 108*b* extends between end rail portion 74 and second guide 104*b*, and restricts clearance therebetween.

As with the head end siderail 18, the foot end siderail 20 includes first and second tubular guides 104*a* and 104*b* extending vertically between mounting bracket 100 and upper rail portion 90. Horizontal blocking member 108*c* extends between end rail portion 92 and guide 104*a* to reduce space therebetween, and horizontal blocking member 108*d* extends between guides 104*a* and 104*b* to restrict clearance therebetween.

Rail extensions 110 and 112 are coupled to head end siderail 18 and foot end siderail 20, respectively. Each rail extension 110 and 112 is supported for translational movement relative to rail members 32 and 36 along generally vertical axes 114 and 116, respectively. Each rail extension 110, 112 illustratively comprises a steel bar or rail positioned directly below the respective siderail 18, 20 and extending in a longitudinal direction. The head end rail extension 18 includes a curved end portion 118 configured to close an end space 120 and prevent access thereto.

Referring to FIGS. 3, 9, 10 and 13, both rail extensions 110 and 112 are supported in identical manners by first and second upwardly extending inserts 122*a* and 122*b*. Each insert 122 illustratively comprises an elongated bar or rod having a lower end 124 coupled to one of rail extensions 110,112 and an upper end 126 slidably received within one of the tubular guides 104. A spring 128 is concentrically received around each insert 122 and is configured to bias the respective rail extension 110, 112 upwardly in the direction of arrow 129. The spring 128 illustratively comprises a conventional compression spring received between upper and lower retainers 130 and 132. Upper retainer 130 illustratively comprises a washer 134 secured to upper end 126 of insert 122 by a fastener 136, such as a screw. Lower retainer 132 illustratively comprises an end cap 138 threadably received within the lower end of guide 104. End cap 138 includes a concentric opening to slidably receive insert 122, and illustratively comprises a nylon bearing. Each guide 104 includes a stop surface 140 which establishes the retracted position of the rail extension 110, 112 by preventing continued upward movement thereof.

Rail members 32 and 36 may assume a plurality of positions relative to deck 14. For example, rail member 32 is shown in a raised position in FIG. 3, in a lowered position in FIG. 6, and in intermediate positions between the raised position and the lowered position in FIGS. 4 and 5. When rail member 32, 36 is in the raised position, rail extension 110, 112 is configured to assume an extended or lowered position extending below the rail member 32, 36. Rail extension 110, 112 blocks a gap 142 defined between the rail member 32, 36 and deck 14. When rail member 110, 112 is lowered, arms 40, 44 cause rail extension 110, 112 to lower. More particularly, arms 40, 44 support actuators 144, illustratively in the form of rotatably supported rollers, which contact the rail extension 110, 112 as the rail member 32, 36 is lowered. It should be appreciated that other actuators may be substituted for the rollers 144. More particularly, a pulley and cable system may be operably coupled with spring 128 thereby extending and compressing spring 128 for raising and lowering the extension rail 110, 112.

Initial contact between the rail extension 110, 112 and the actuators 144 causes initial vertical movement of the rail extension 110, 112 from the retracted position downwardly relative to rail member 32, 36. Further raising of rail member 32, 36 causes rail extension 110, 112 to move further downwardly such that when the rail member 32, 36 is fully raised, the rail extension 110, 112 is in the fully extended position. The rail extension 110, 112 does not impede the movement of the rail member 32, 36 between the raised and lowered positions. When siderail 18, 20 is in a fully lowered position, rail extension 110, 112 is in the fully retracted position relative to rail member 32, 36. When siderail 18, 20 is not in a fully lowered position, the vertical position of rail extension 110, 112 relative to rail member 32, 36 is determined by contact with rollers 144 supported by arms 40, 44, and contact between rail extension 110, 112 and rollers 144 remains constant. As the arms 40, 44 move rail member 32, 36, the rollers 144 rotate and roll along an upper surface 146, 148 of rail extension 110, 112. When siderail 18, 20 is in the fully raised position, rail extension 110, 112 is in the fully extended position relative to rail member 32, 36.

In operation, as the siderail 18, 20 is raised, rollers 144 push the rail extension 110, 112 down, compressing the springs 128 received within the guides 104 of the respective siderail 18, 20. As the siderail 18, 20 is lowered, the springs 128 bias the extension rail 110, 112 upwardly toward the siderail 18, 20. The retracting extension rail 110, 112 allows the patient support 10 to achieve a lower "low" position, while still providing a siderail 18, 20 that fully stows, thereby allowing a zero-transfer gap between the patient support 10 and another patient support.

Figure 6:
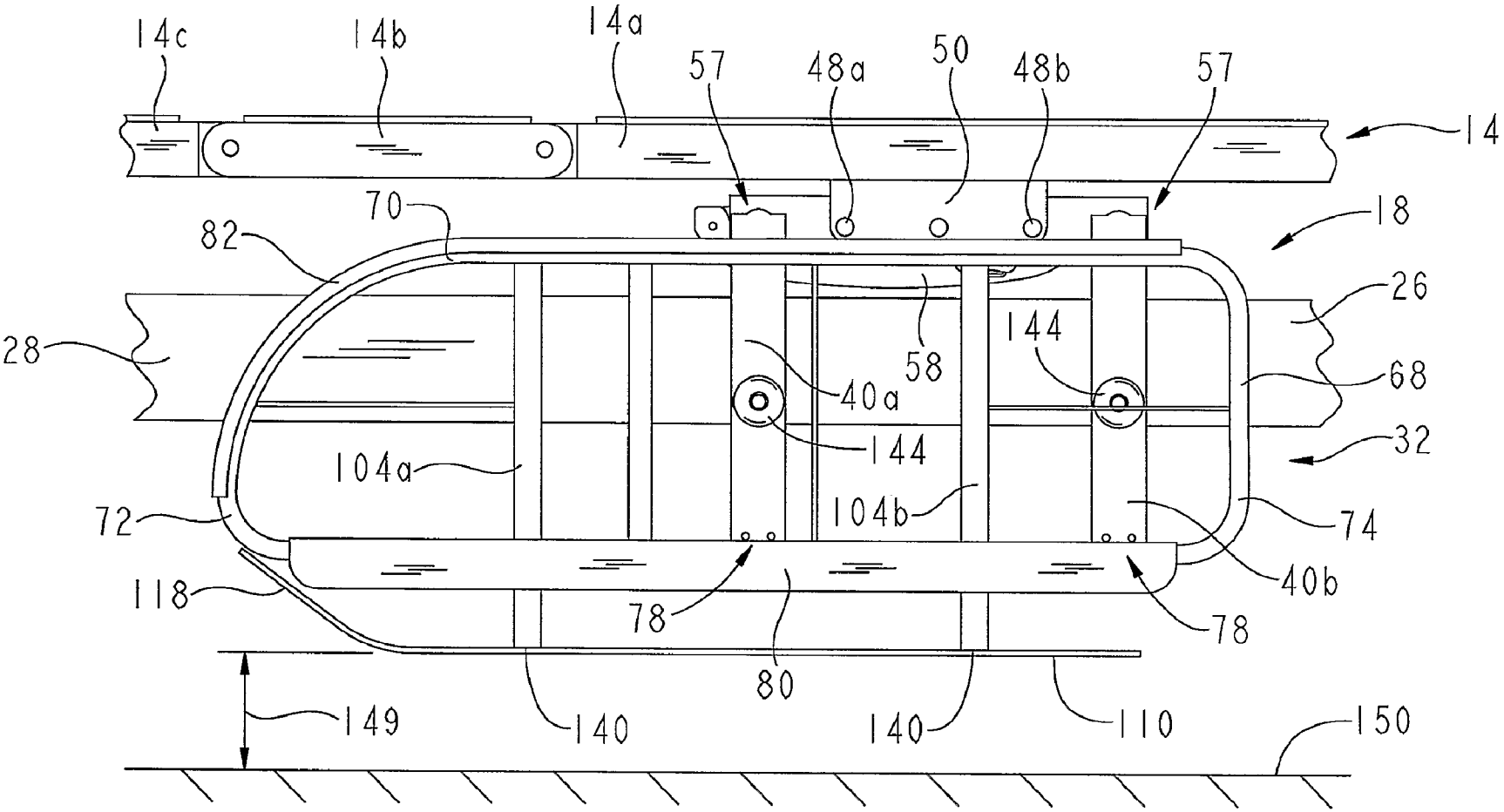
FIG. 6 is a front elevational view similar to FIG. 3, illustrating the head end siderail in the lowered position, wherein the head rail member is in a lowered position and the rail extension is in a retracted position.
Figure 7:
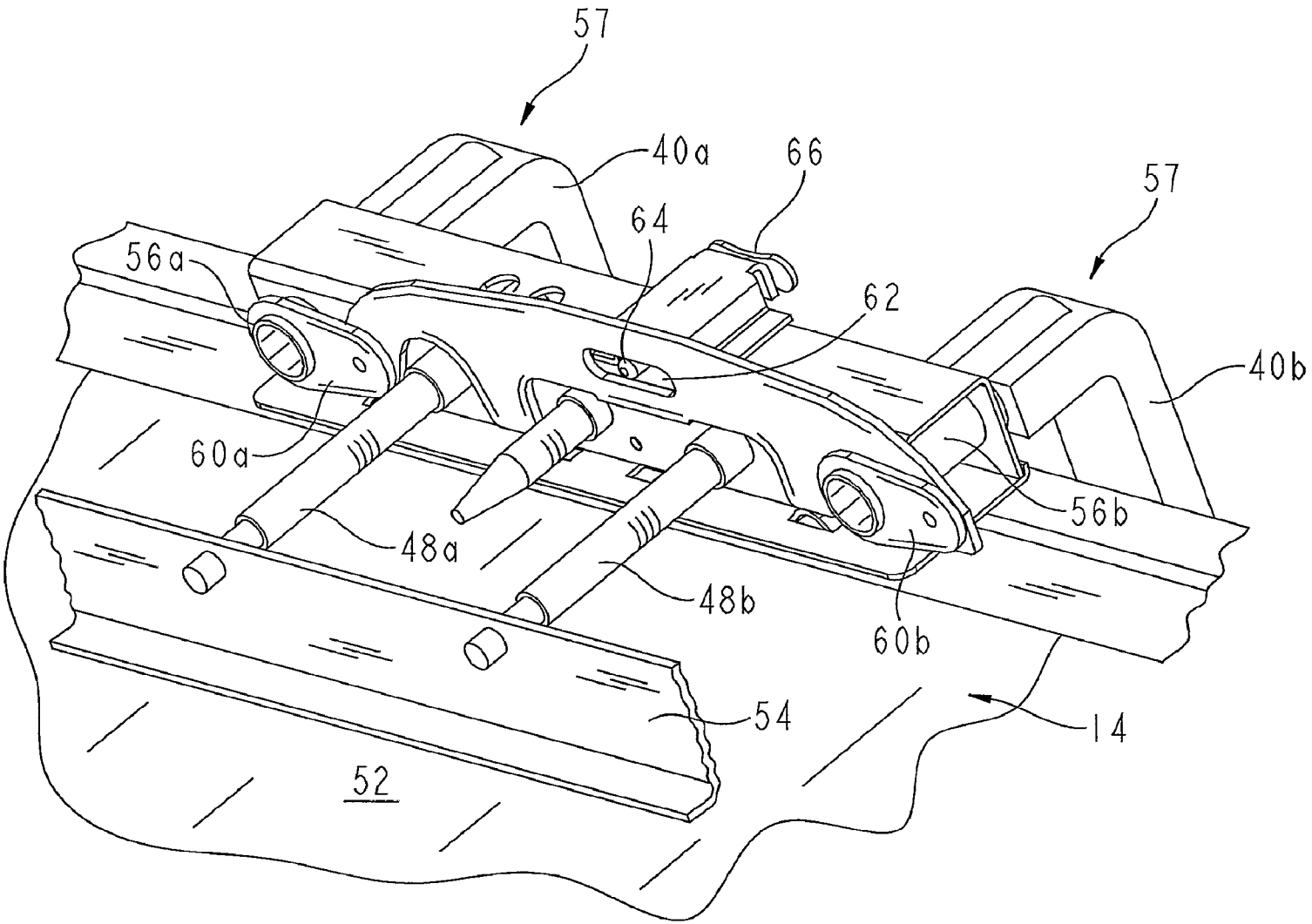
FIG. 7 is a perspective view of the linkage of the head end siderail, showing the latch in a locked position preventing movement of the arms relative to the slide bracket.
Figure 8:
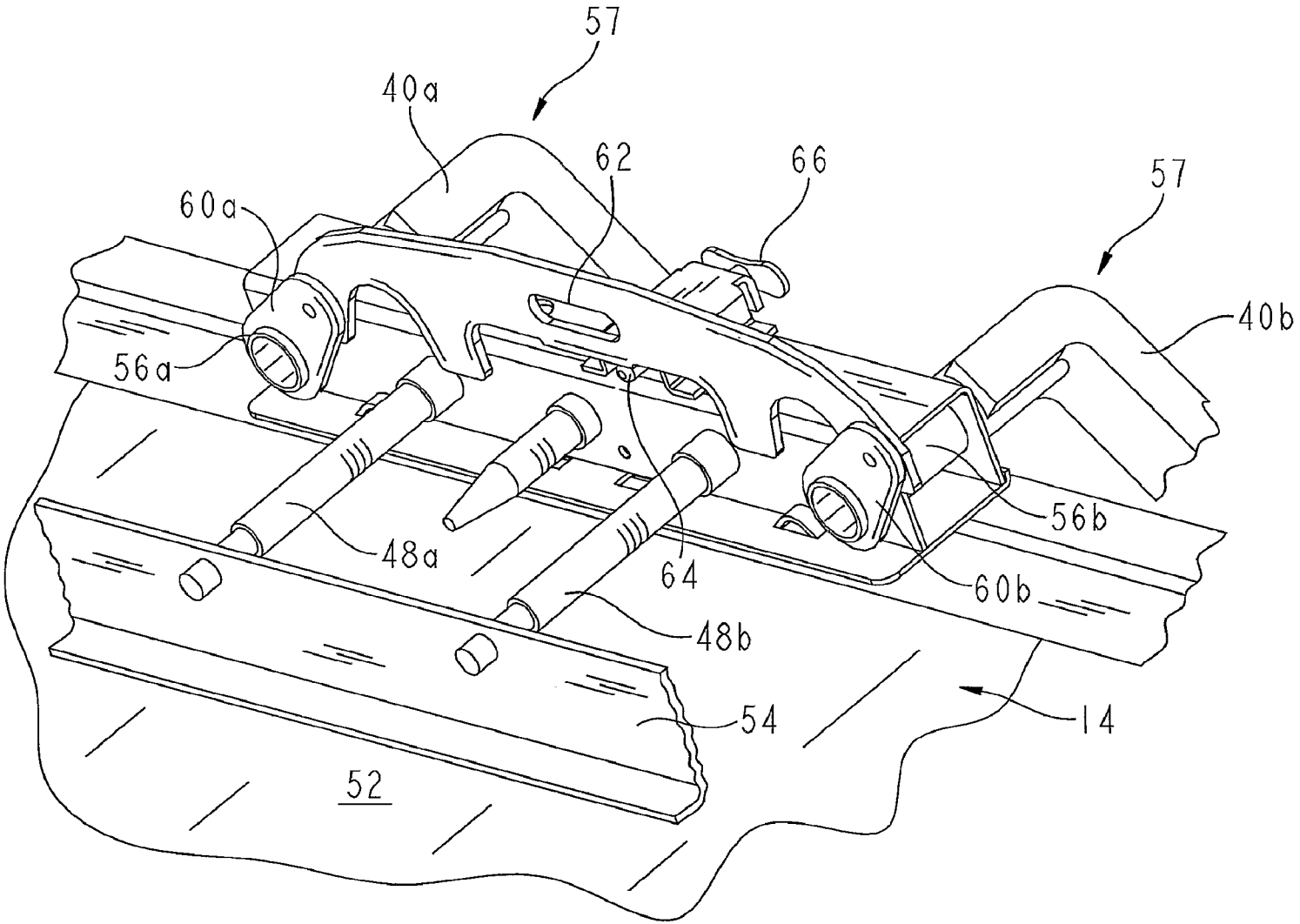
FIG. 8 is a perspective view similar to FIG. 7, showing the latch in an unlocked position permitting movement of the arms relative to the slide bracket.
Figure 9:
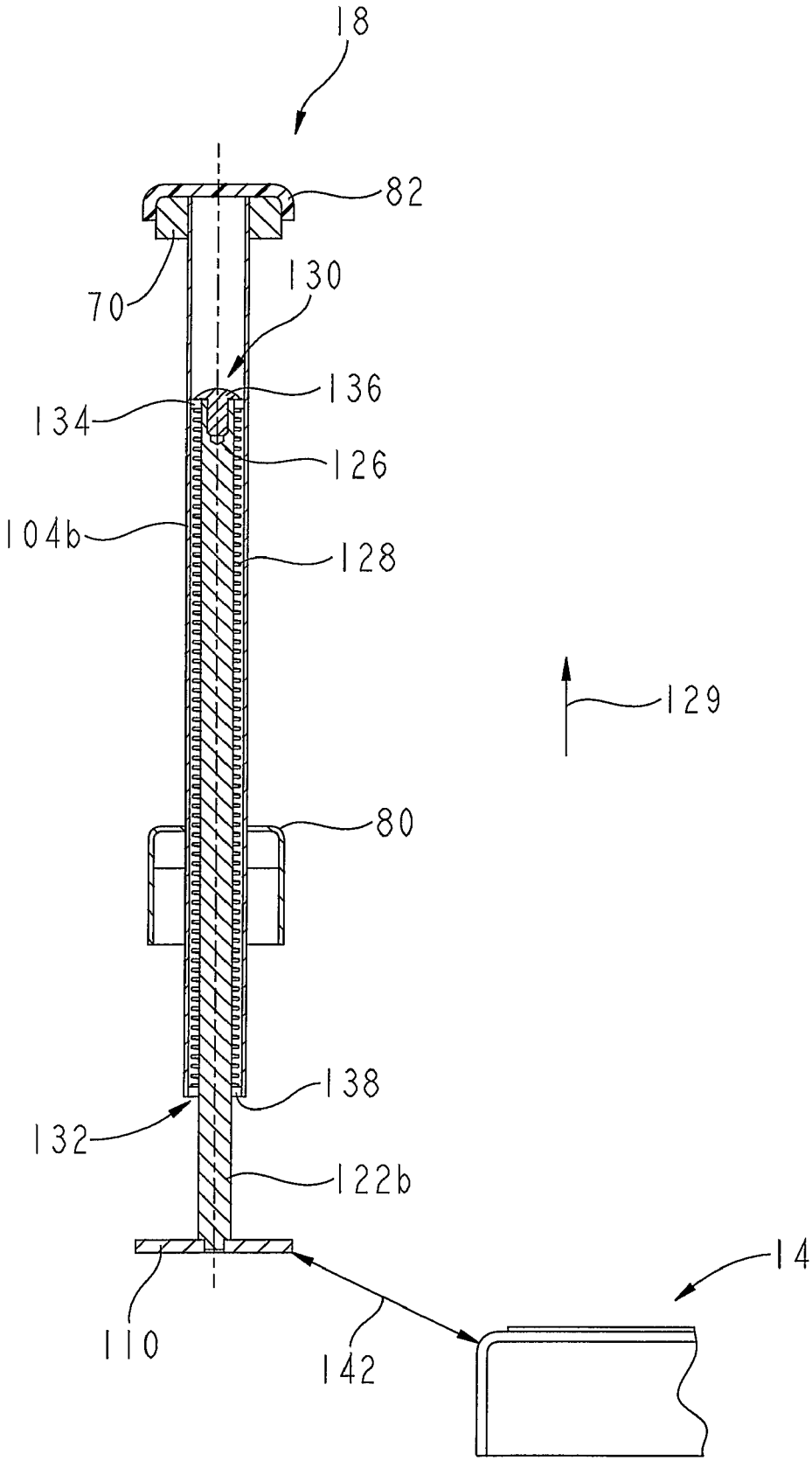
FIG. 9 is a cross-sectional view taken along line 9-9 of FIG. 3.
Figure 10:
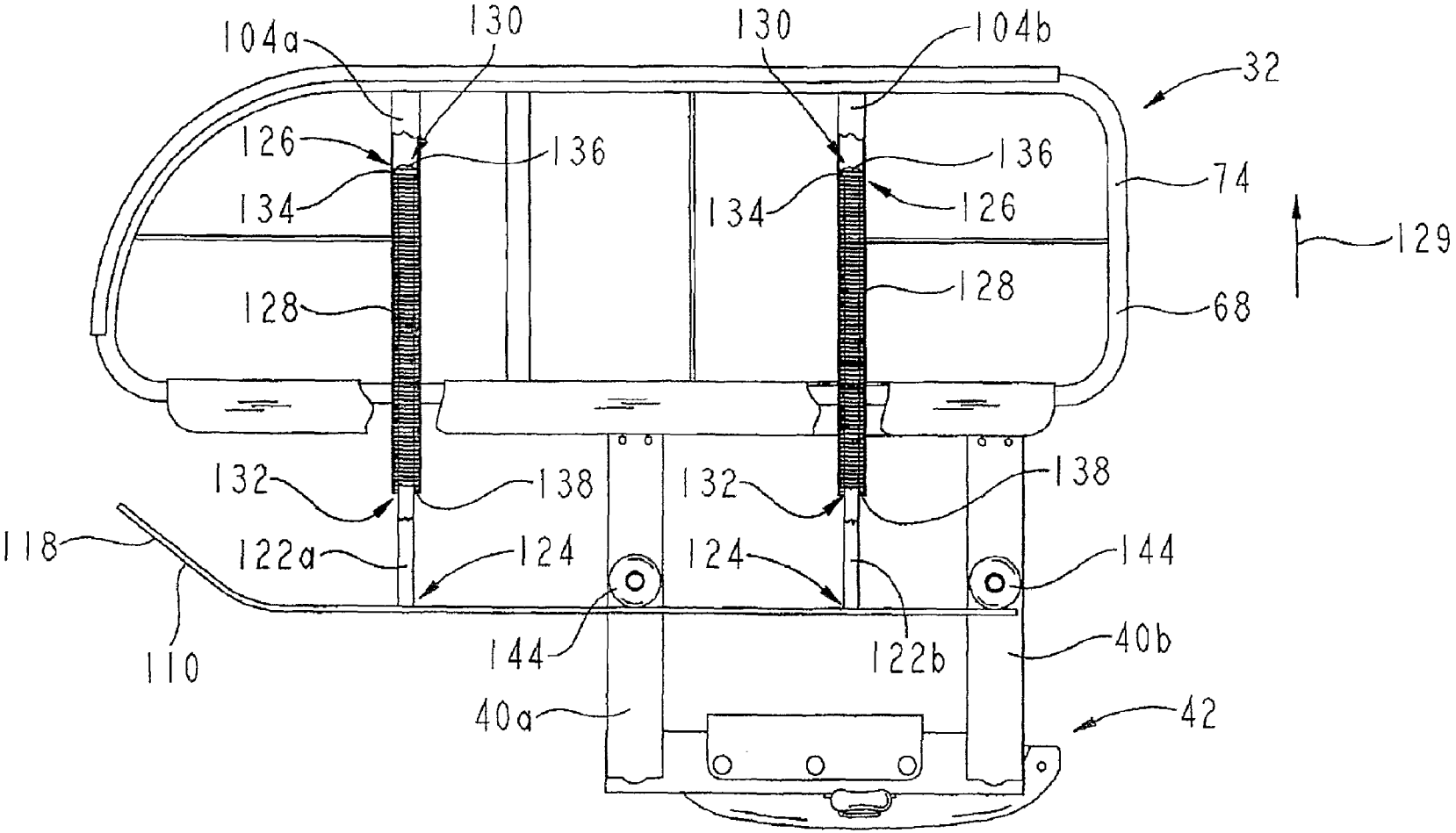
FIG. 10 is a front elevational view of the head end siderail, showing the springs cooperating with the inserts supporting the rail extension.
Figure 11:
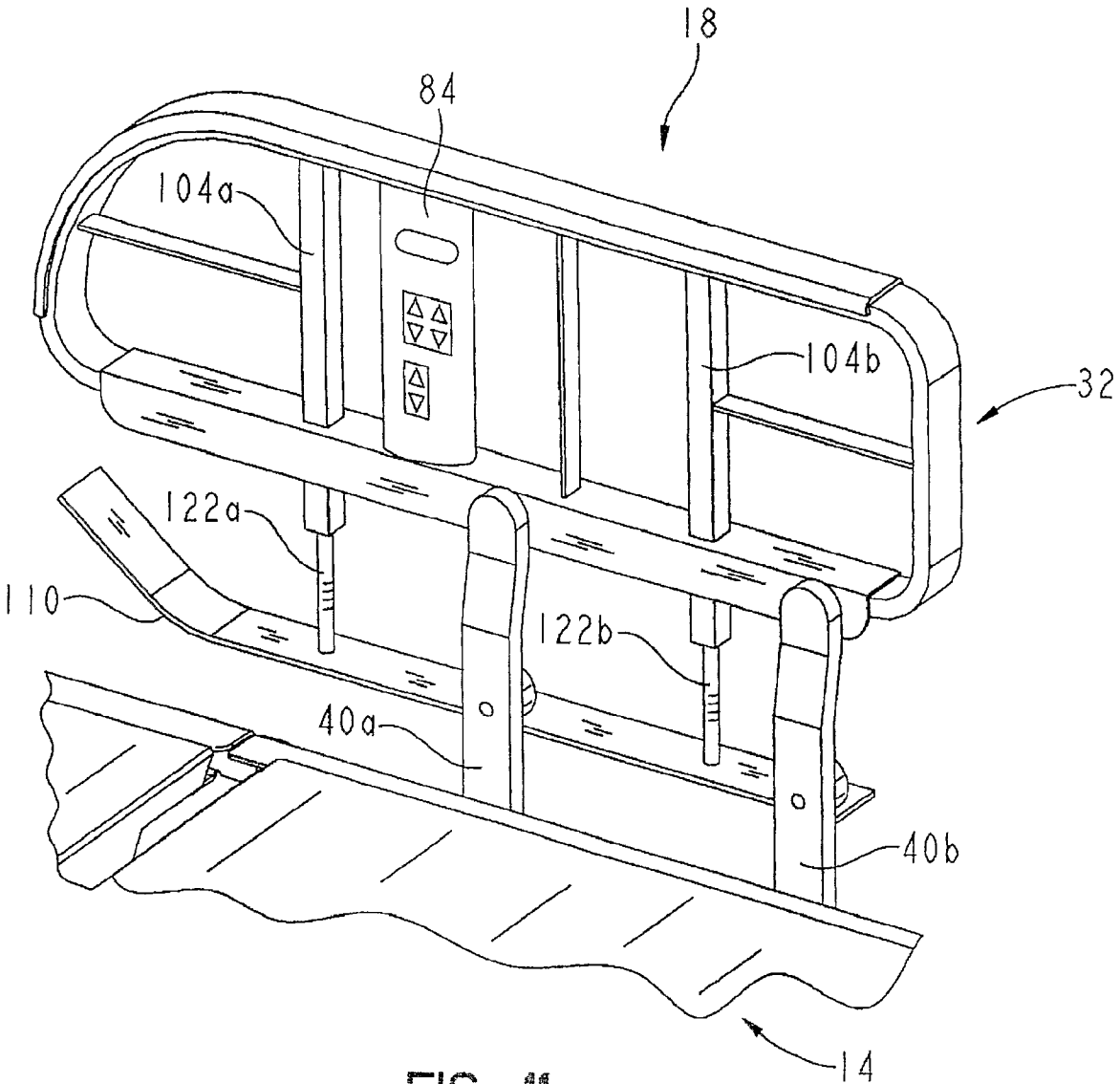
FIG. 11 is a rear perspective view of the head end siderail of FIG. 3.
Figure 12:
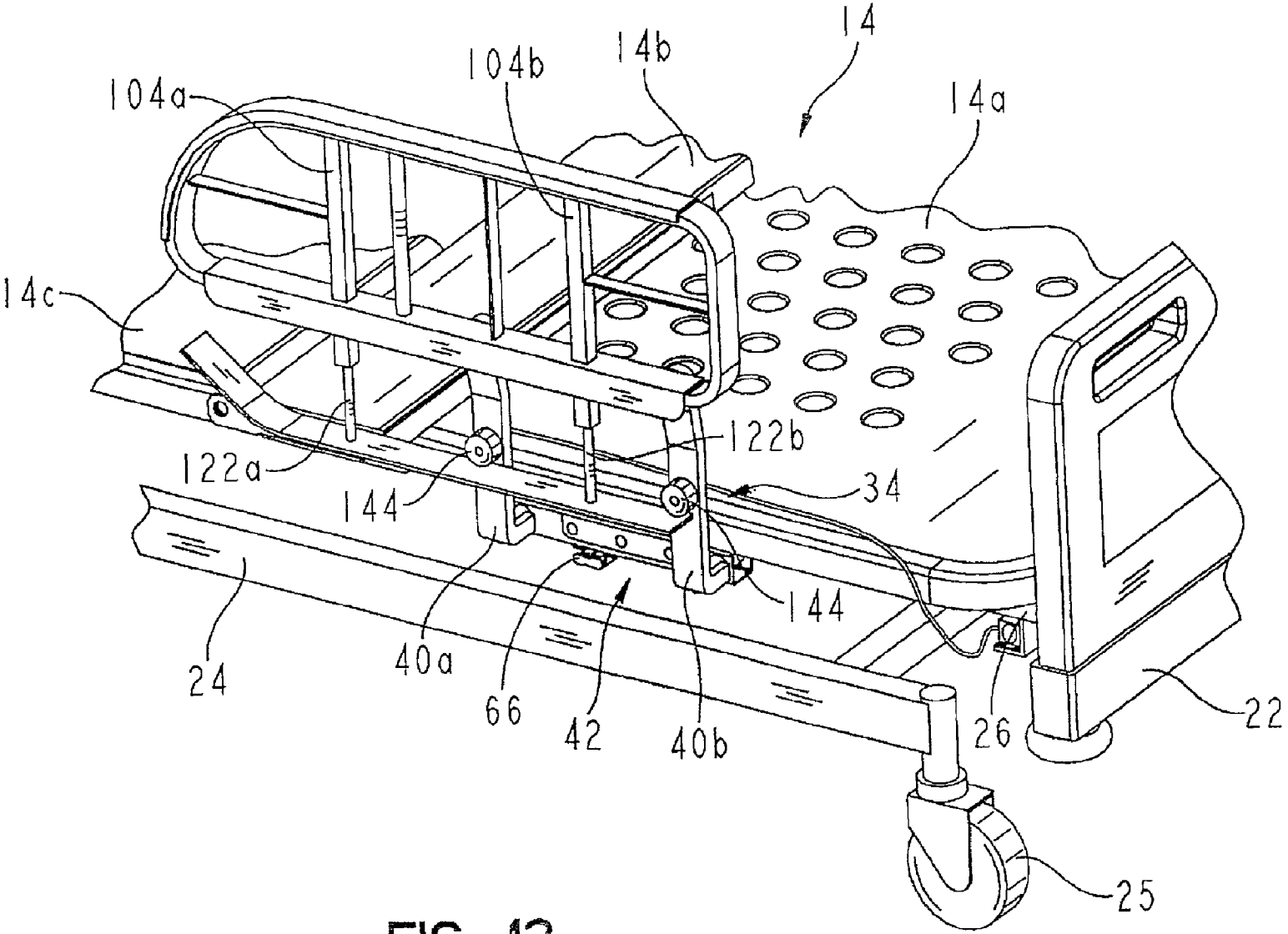
FIG. 12 is a detail perspective view of the actuator and extension rail of the head end siderail of FIG. 3.

As illustrated in FIG. 9, each rail extension 110, 112 is configured to reduce the size of gap 142 between deck 14 and respective siderail 18, 20. More particularly, rail extension 110, 112 is configured to maintain the size of gap 142 to less than 60 millimeters (mm) between respective siderail 18, 20 and deck 14. As illustrated in FIG. 6, the rail extension 110, 112 is further configured to maintain a clearance 149 of greater than 120 millimeters (mm) between respective siderail 18, 20 and the floor 150 when siderail 18, 20 is in the lowered position and patient support 10 is in its lowest position (i.e., intermediate frame 26 is in its lowest position relative to base frame 24, and deck 14 is in its lowest position relative to intermediate frame 26).

Although the invention has been described in detail with reference to certain preferred embodiments, variations and modifications exist within the spirit and scope of the invention as described and defined in the following claims.

The invention claimed is:

1. A siderail for use with a patient support, the siderail being configured to move between a raised position and a lowered position, the siderail comprising:

a rail member;

a rail extension coupled to the rail member, the rail extension being configured to move between an extended position relative to the rail member when the siderail is in a raised position and a non-extended position relative to the rail member when the siderail is in a lowered position;

a linkage wherein the linkage causes the rail extension to move between the extended and non-extended positions; and an actuator operably coupled to the linkage and configured to cause the rail extension to move between the extended and retracted positions, wherein the actuator comprises at least one rotatably supported roller configured to engage an upper surface of the rail extension.

2. The siderail of claim 1, wherein the at least one roller is configured to roll along the upper surface of the rail extension as the rail member is moved into the raised position.

3. The siderail of claim 1, wherein the linkage is a clocking linkage.

4. The siderail of claim 1, wherein the rail extension is configured to move along a vertical axis relative to a lower edge of the rail member.

5. The siderail of claim 1, comprising a linkage configured to permit raising and lowering of the rail member, wherein the rail extension is positioned above a first end of the linkage when the rail member is in the raised position and the rail extension is below the first end of the linkage when the rail member is in the lowered position.

6. The siderail of claim 5, wherein the patient support includes an articulated deck, the first end of the linkage being rotatably supported by the deck, and the second end of the linkage rotatably supporting the rail member.

7. A siderail for use with a patient support, the siderail comprising:

a rail member;

a linkage supporting the rail member for vertical movement between a raised position and a lowered position;

a rail extension operably coupled to the rail member, the rail extension being configured to move downwardly in response to movement of the linkage in a first direction and the rail extension being configured to move upwardly in response to movement of the linkage in a second direction opposite of the first direction; and an actuator operably coupled to the linkage and configured to engage an upper surface of the rail extension as the rail member moves upwardly from the lowered position to the raised position, wherein the actuator comprises at least one rotatably supported roller configured to roll along the upper surface of the rail extension as the rail member is moved into the raised position.

8. The siderail of claim 7, further comprising a biasing device perably coupled to the rail extension and configured to bias the rail extension upwardly.

9. A siderail for use with a patient support, the siderail comprising:

a rail member;

a linkage supporting the rail member for vertical movement between a raised position and a lowered position;

a rail extension operably coupled to the rail member, the rail extension being configured to move downwardly in response to movement of the linkage in a first direction and the rail extension being configured to move upwardly in response to movement of the linkage in a second direction opposite of the first direction; and a biasing device operably coupled to the rail extension and configured to bias the rail extension upwardly, wherein the biasing device comprises a spring operably coupled intermediate the rail member and the rail extension.

10. A siderail for use with a patient support, the siderail comprising:

a rail member;

a linkage supporting the rail member for vertical movement between a raised position and a lowered position; and a rail extension operably coupled to the rail member, the rail extension being configured to move downwardly in response to movement of the linkage in a first direction and the rail extension being configured to move upwardly in response to movement of the linkage in a second direction opposite of the first direction, wherein the rail extension includes an upwardly extending guide member, and the rail member includes a tubular support configured to slidably receive the guide member.

11. The siderail of claim 10, wherein the rail member includes a frame member, at least one vertical blocking member coupled to the frame member, and at least one horizontal blocking member coupled to the frame member.

12. The siderail of claim 10, wherein the linkage includes a first arm and a second arm positioned in spaced relation to the first arm, each of the first arm and the second arm including a first end rotatably coupled to the patient support and a second end rotatably coupled to the rail member.

13. A siderail for use with a patient support, the siderail comprising:

a rail member supported for movement between a raised position and a lowered position;

a rail extension operably coupled to the rail member, the rail extension configured to move to a retracted position as the rail member moves to the lower position and configured to move to an extended position as the rail member moves to the upper position; and an actuator operably coupled to the linkage and configured to cause the rail extension to move to the extended position as the rail member is moved to the raised position, wherein the actuator comprises at least one rotatably supported roller configured to engage an upper surface of the rail extension.

14. The siderail of claim 13, further comprising a linkage operably coupled to the rail member, the linkage configured to cause the rail member to move between the upper position and the lower position and to cause the rail extension to move between the extended position and the retracted position.

15. The siderail of claim 13, wherein the rail extension is positioned below the rail member, the rail extension in the retracted position being positioned closer to the rail member than the rail extension in the extended position.

16. The siderail of claim 13, wherein the at least one roller is configured to roll along the upper surface of the rail extension as the rail member is moved into the raised position.

17. The siderail of claim 13, further comprising a biasing device operably coupled to the rail extension and configured to bias the rail extension to the retracted position.

18. A siderail for use with a patient support, the siderail comprising:

a rail member supported for movement between a raised position and a lowered position;

a rail extension operably coupled to the rail member, the rail extension configured to move to a retracted position as the rail member moves to the lower position and configured to move to an extended position as the rail member moves to the upper position; and a biasing device operably coupled to the rail extension and configured to bias the rail extension to the retracted position, wherein the biasing device comprises a spring operably coupled intermediate the rail member and the rail extension.

19. A siderail for use with a patient support, the siderail comprising:

a rail member supported for movement between a raised position and a lowered position;

a rail extension operably coupled to the rail member, the rail extension configured to move to a retracted position as the rail member moves to the lower position and configured to move to an extended position as the rail member moves to the upper position, wherein the rail extension includes an upwardly extending guide member, and the rail member includes a tubular support configured to slidably receive the guide member.

20. The siderail of claim 19, wherein the tubular support includes a stop to prevent continued movement of the rail extension from the extended position to the retracted position.

21. The siderail of claim 19, wherein the rail member includes a frame member, at least one vertical blocking member coupled to the frame member, and at least one horizontal blocking member coupled to the frame member.

22. The siderail of claim 19, wherein the rail extension is positioned intermediate the first and second ends of the first and second arms when the rail member is in the raised position, and the rail extension is positioned below the first and second ends of the first and second arms when the rail member is in the lowered position.

* * * * *